US009109369B2

(12) United States Patent
Schaefer

(10) Patent No.: US 9,109,369 B2
(45) Date of Patent: Aug. 18, 2015

(54) BUILDING INSULATION AND SIDING KIT

(71) Applicant: Fiber Cement Foam Systems Insulation, LLC, Manalapan, NJ (US)

(72) Inventor: Russ Schaefer, Manalapan, NJ (US)

(73) Assignee: Fiber Cement Foam Systems Insulation, LLC, Manalapan, NJ (US)

( * ) Notice: Subject to any disclaimer, the term of this patent is extended or adjusted under 35 U.S.C. 154(b) by 0 days.

(21) Appl. No.: 14/215,929

(22) Filed: Mar. 17, 2014

(65) Prior Publication Data

US 2014/0260048 A1 Sep. 18, 2014

Related U.S. Application Data

(60) Provisional application No. 61/792,943, filed on Mar. 15, 2013.

(51) Int. Cl.
*E04F 13/08* (2006.01)

(52) U.S. Cl.
CPC ..... *E04F 13/0864* (2013.01); *E04F 13/0841* (2013.01); *E04F 13/0878* (2013.01)

(58) Field of Classification Search
CPC ..... E04F 13/0864; E04F 13/0841; E04F 13/0878
USPC ..... 52/518, 520, 509, 746.1, 745.05, 745.1, 52/543, 519, 546–547, 551–553, 549, 52/302.3; 33/493–494, 613, 645, 33/758–760, 771, 563
See application file for complete search history.

(56) References Cited

U.S. PATENT DOCUMENTS

| | | | | |
|---|---|---|---|---|
| 3,095,671 | A * | 7/1963 | Fink et al. | 52/551 |
| 3,511,008 | A * | 5/1970 | Grems et al. | 52/309.8 |
| 3,552,078 | A * | 1/1971 | mattes | 52/520 |
| 4,034,528 | A * | 7/1977 | Sanders et al. | 52/309.4 |
| 4,096,011 | A * | 6/1978 | Sanders et al. | 156/196 |
| 4,607,438 | A * | 8/1986 | DeFrange | 33/451 |
| 5,564,245 | A * | 10/1996 | Rademacher | 52/520 |
| 6,494,014 | B2 * | 12/2002 | Lafrance | 52/745.05 |
| 8,453,408 | B2 * | 6/2013 | Kalkanoglu et al. | 52/520 |
| 8,499,517 | B2 * | 8/2013 | Wilson et al. | 52/519 |
| 2009/0205277 | A1 * | 8/2009 | Gibson | 52/309.9 |
| 2011/0154759 | A1 * | 6/2011 | Wilson et al. | 52/302.1 |
| 2013/0036699 | A1 * | 2/2013 | Holt | 52/509 |

FOREIGN PATENT DOCUMENTS

DE 4403865 C1 * 6/1995

* cited by examiner

*Primary Examiner* — Jeanette E Chapman
(74) *Attorney, Agent, or Firm* — Gearhart Law, LLC

(57) ABSTRACT

A building side kit is provided where the siding board is attached to an insulation board from their upper edges and a one step installation of the kit is provided with attachment clips. The insulation boards may have interlocking male extension and female deeps on their upper and lower edges. Attachment clips fitting with siding board/insulation board assemblies with male extensions on the upper edge of the insulation board are also provided. The system may also include a reflective backing and/or drainage grooves on the back of the insulation board.

9 Claims, 3 Drawing Sheets

BUILDING INSULATION AND SIDING KIT

PRIORITY

This application claims priority of U.S. provisional application No. 61/792,943 filed on Mar. 15 2013, the contents of which is incorporated herein by reference in its entirety.

FIELD OF THE INVENTION

The invention relates to the installation of insulation and building siding. More particularly to products and processes related to installing insulation foam and siding plank at one step.

BACKGROUND OF THE INVENTION

Houses in America often have their exterior walls clad with siding to protect the predominately wooden construction from the elements. Vinyl siding has become particular popular over the last several decades as it is inexpensive, relatively easy to clean and relatively durable. However, in recent years, fiber cement siding has begun to replace vinyl siding. Fiber cement is a product made of sand, cement and cellulose. As a siding material, fiber cement has advantages over both wood and vinyl in that it is rot resistant, termite resistant and non-combustible. Because of these properties fiber cement siding has become widely used in bush fire regions of Australia, and is now becoming a material of choice for new construction in the US. Fiber cement siding can also be painted and can be made to look like wood. Another common siding material is composite siding.

The system and method of this invention provide both increased thermal insulation and a one step installation of insulation foam and siding plank. Additionally the invention substantially simplifies alignment of the planks. The simplified alignment significantly reduces the time to install the siding.

DESCRIPTION OF THE RELATED ART

US patent application 2013/0036699 describes an attachment member for use with an insulation panel or composite panel. The attachment member includes a male connecting member, a hem portion, and a connection portion joining the female connecting member and the hem portion. The male connecting member extends into the body of a foam insulating layer along a first end edge. The attachment member and the first end edge cooperate to be complementary in shape with the second end edge such that adjacent panels and engage with each other.

WO2013/152048 discloses an integrated fiber cement and foam cladding system where a foam layer is disposed on the fiber cement layer and attached there by an adhesive layer.

Various implements are known in the art, but fail to address all of the problems solved by the invention described herein. One embodiment of this invention is illustrated in the accompanying drawings and will be described in more detail herein below.

SUMMARY OF THE INVENTION

The present invention relates to a method to install insulation foam and siding planks in one step. It is an object of this invention to provide a building side kit where the siding board is attached to an insulation board from their upper edges. The kit additionally includes clips to attach the siding board/insulation boar assembly. The kit and method provided here allows a faster installation of insulated siding on houses and secure attachment of the boards with the clips to prevent damage by whether elements, such as stormy winds.

It is an object of this invention to provide a building insulation and siding kit comprising; at least two siding board/insulation board assemblies; and at least two attachment clips; said siding board/insulation board assemblies comprising a siding board having an upper edge and a lower edge and an insulation board having an upper edge and a lower edge; said insulation boards having a length substantially same as the length of the siding boards, and a width narrower than the width of the siding boards; each of said siding boards being attached from their upper edges to the upper edges of the insulation boards; said attachment clips having a substantially rectangular front prong perpendicularly attached to a substantially rectangular horizontal plate, and a substantially rectangular hind prong being perpendicularly attached to the horizontal plate at an opposite end of the horizontal plate, and said hind prong having an upwardly extending portion, wherein the hind prong and/or the upwardly extending portion have one or more attachment holes; the horizontal prong having a width substantially same as breadth of the siding board/insulation board assembly, whereby the siding board/insulation board assembly snugly fits on the horizontal plate between the front and hind prong of the clip; wherein one siding board/insulation board assembly is inserted between the front and hind prongs of one clip, and the clip is attached to a building wall structure with fasteners through the attachment holes; and wherein another siding board/insulation board assembly is inserted between the front and hind prongs of another clip and aligned along the upper edge of the first insulation board.

It is another object of this invention to provide a method to install a siding on a wall structure, said method comprising the steps of: a) providing a building insulation and siding kit comprising at least two siding board/insulation board assemblies, and attachment clips of claim 1; b) inserting one siding board/insulation board assembly between the front and hind prongs of one clip; c) Attaching the assembly on the building wall structure with fasteners through attachment holes of the clip; d) Inserting another siding board/insulation board assembly between the front and hind prongs of another clip; e) aligning lower edge of the insulation board of the second assembly along the upper edge of the first assembly; f) attaching the second assembly on the building wall structure with fasteners through attachment holes of the clip; and g) repeating steps b) to f) until the wall structure is covered.

It is yet another object of the invention to provide a method to install a siding on a wall structure, said method comprising the steps of: a) providing a building insulation and siding kit comprising at least two siding board/insulation board assemblies, and attachment clips of claim 4; b) inserting one siding board/insulation board assembly between the front and hind prongs of one clip; c) Attaching the assembly on the building wall structure with fasteners through attachment holes of the clip; d) inserting another siding board/insulation board assembly between the front and hind prongs of another clip; e) Aligning lower edge of the insulation board of the second assembly along the upper edge of the first assembly; f) attaching the second assembly on the building wall structure with fasteners through attachment holes of the clip; and g) Repeating steps b) to f) until the wall structure is covered.

DESCRIPTION OF THE PREFERRED EMBODIMENTS

Figure 1:
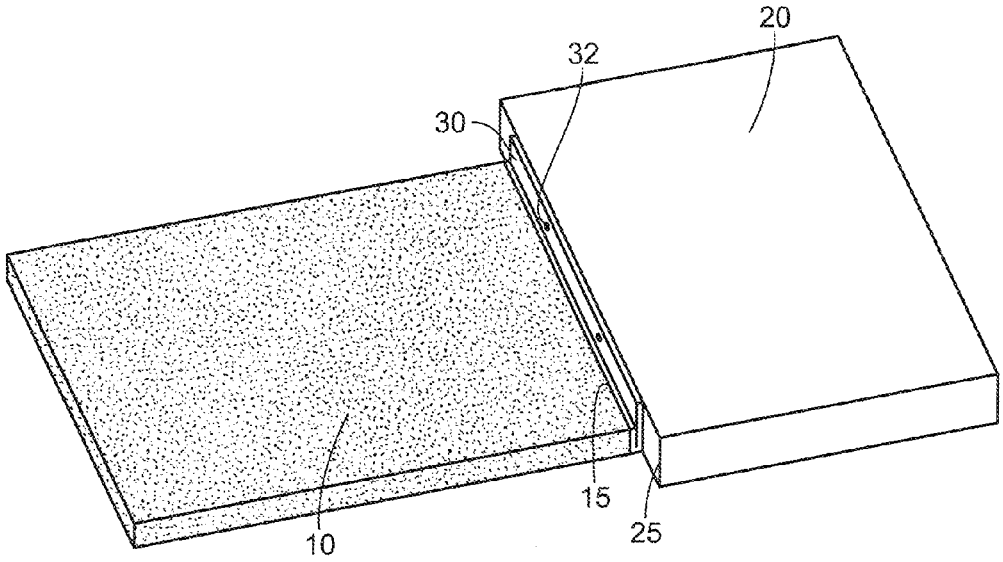
FIG. 1 shows a front perspective view of the siding board/insulation board assembly of this description. The figure shows the siding board 10, the insulation board 20, the upper edge of the siding board (UESB) 15, the upper edge of the insulation board (UEIB) 25 and the attachment 30 between the siding board and the insulation board. The figure also shows the attachment 30 having stud markings 32.

The preferred embodiments of the present invention will now be described with reference to the drawings. Identical elements in the various figures are identified with the same reference numerals.

Reference will now be made in detail to embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

FIG. 1 shows a front perspective view of the siding board/insulation board assembly of this description. The figure shows the siding board 10, the insulation board 20, the upper edge of the siding board (UESB) 15, the upper edge of the insulation board (UEIB) 25 and the attachment 30 between the siding board and the insulation board. The figure also shows the attachment 30 having stud markings 32.

According to a preferred embodiment the attachment 30 is tape. Other adhesives may also be used. The attachment 30 may also be flexible material. According to a preferred embodiment the attachment tape connects the upper edge of the siding board (UESB) 15 and the upper edge of the insulation board (UEIB) 25 and is attached to the upper edges. According to one preferred embodiment the tape has stud markings showing preferable placement of the clip to attach the siding board/insulation board on the studs of the wall structure. The stud markings 32 may be dots, lines, numbers, or any combination thereof. The stud markings 32 may also be of different colors with predetermined meanings, such as showing studs that are 16 inches apart or 24 inches apart each other. It is also possible to attach the adhesive material on the upper inner surfaces of the siding board and the insulation boar, but this embodiment could not include the stud markings as the adhesive would not be visible to the installer.

According to one preferred embodiment the siding board is glued on the insulation board. The glue may be applied throughout the boards.

Figure 2:
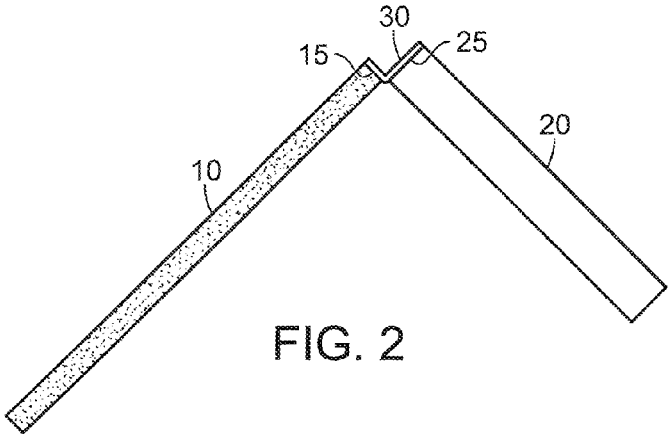
FIG. 2 shows attachment of the siding board 10 and the insulation board 20. The figure show the siding board 10, the insulation board 20, the upper edge of the siding board (UESB) 15, the upper edge of the insulation board (UEIB) 25 and the attachment 30 between the siding board and the insulation board along the upper edges 15 (UESB) and 25 (UEIB).

FIG. 2 shows attachment of the siding board and the insulation board in a side view. The figure show the siding board 10, the insulation board 20, the upper edge of the siding board (UESB) 15, the upper edge of the insulation board (UEIB) 25 and the attachment 30 between the siding board and the insulation board along the upper edges 15 (UESB) and 25 (UEIB).

Figure 3:
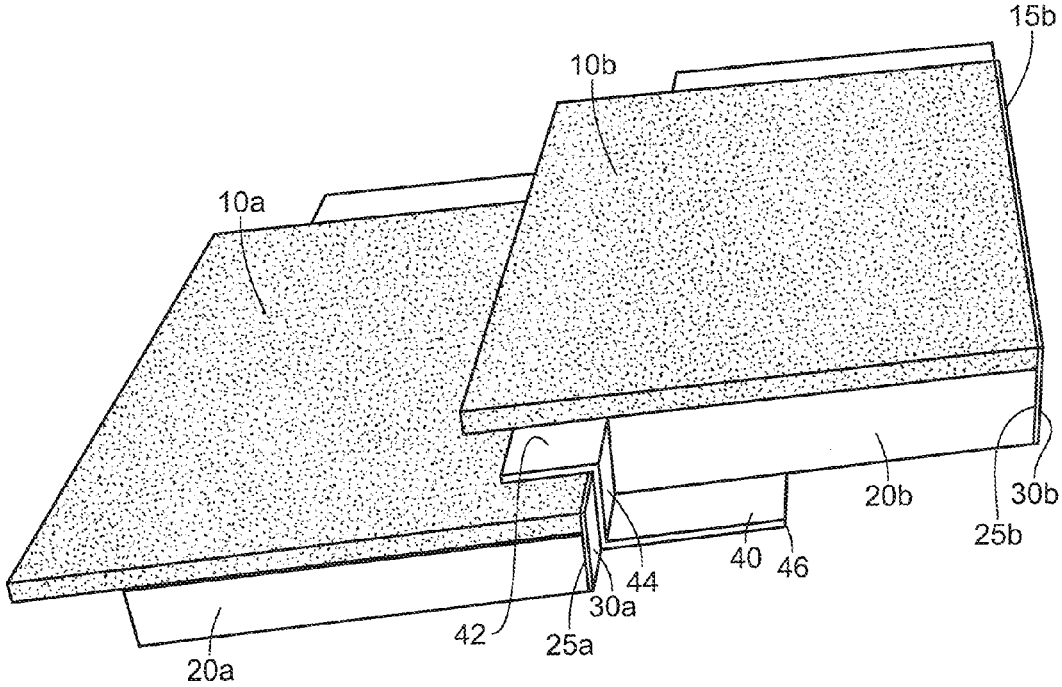
FIG. 3 shows installation of the siding board/insulation board assemblies with an attachment clips. The figure shows a first siding board 10*a* attached to a first insulation board 20*a* with an attachment 30*a* along the upper edge of the first siding board (UESB) 15*a* and the upper edge of the first insulation board (UEIB) 25*a*, a second siding board 10*b* attached to a second insulation board 20*b* with an attachment 30*b* along the upper edge of the second siding board (UESB) 15*b* and the upper edge of the second insulation board (UEIB) 25*b*, and a clip 40. The figure shows the front prong 42 of the clip, the horizontal plate 44 of the clip and the upwardly extending portion 46 of the clip. The hind prong of the clip is not visible as it is under the first insulation board 20*a*.

FIG. 3 shows installation of the siding board/insulation board assemblies with an attachment clips. The figure shows a first siding board 10*a* attached to a first insulation board 20*a* with an attachment 30*a* along the upper edge of the first siding board (UESB) 15*a* and the upper edge of the first insulation board (UEIB) 25*a*, a second siding board 10*b* attached to a second insulation board 20*b* with an attachment 30*b* along the upper edge of the second siding board (UESB) 15*b* and the upper edge of the second insulation board (UEIB) 25*b*, and a clip 40. The figure shows the front prong 42 of the clip, the horizontal plate 44 of the clip and the upwardly extending portion 46 of the clip. The hind prong of the clip is not visible as it is under the first insulation board 20*a*.

According to one preferred embodiment the clip 40 has at least one attachment hole. The attachment holes may locate in the hind prong, and/or on the upwardly extending portion. According to one preferred embodiment an attachment hole is also located on the front prong and the assembly is attached to the wall structure by nailing or screwing through via front prong hole, through the assembly and via the hind prong hole. Such clip has been described in U.S. patent application Ser. No. 14/164,697, the contents of which are fully incorporated herein by reference.

According to one embodiment the width of the clip is substantially same as the length of the siding board, whereby only one clip is used for attaching one siding board. Alternatively the clip can be positioned so that half of it covers half of one siding board/insulation assembly and the other half covers another one.

According to one preferred embodiment the width of the siding board is larger than the width of the insulation board. This can be seen in FIGS. 1 through 5. This allows the lower portion of the insulation board to cover the front prong of the clip attaching adjacent siding board/insulation board-assembly. According to a preferred embodiment the length of the front prong is smaller than the difference between the widths of an insulation board and of a siding board. This allows the front prong of the clip being totally invisible when the siding board of an above adjacent siding board covers it.

According to one preferred embodiment the insulation board is slightly thicker at its lower end than its upper end. This allows the siding boards to locate in a slight angle and the lower end of one siding board to cover the upper end of adjacent siding board below it.

According to one preferred embodiment the back side of the insulation boards is flat.

According to another preferred embodiment the back sides of the insulation boards have substantially vertical grooves for water drainage. Such grooves have been described in U.S. patent application Ser. Nos. 13/029,336 and 13/450,165, the contents of which are fully incorporated herein by reference.

Figure 4:
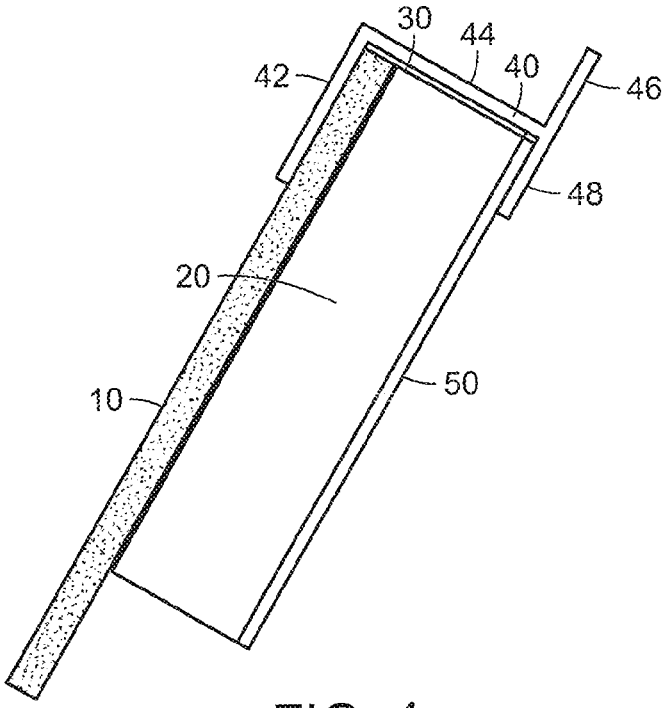
FIG. 4 shows a side view of the siding board/insulation board assembly. The figure shows the siding board 10, the insulation board 20, the clip 40. The clip has a front prong 42, a horizontal plate 44, a hind prong 48 and a upwardly extending portion 46. In this embodiment the siding board/insulation board assembly additionally has a reflecting backing 50 attached on back side of the foam board. The attachment is illustrated with element number 30.

FIG. 4 shows a side view of the siding board/insulation board assembly. The figure shows the siding board 10, the insulation board 20, the clip 40. The clip has a front prong 42, a horizontal plate 44, a hind prong 48 and an upwardly extending portion 46. In this embodiment the siding board/insulation board assembly additionally has a reflecting backing 50 attached on back side of the foam board.

Figure 5:
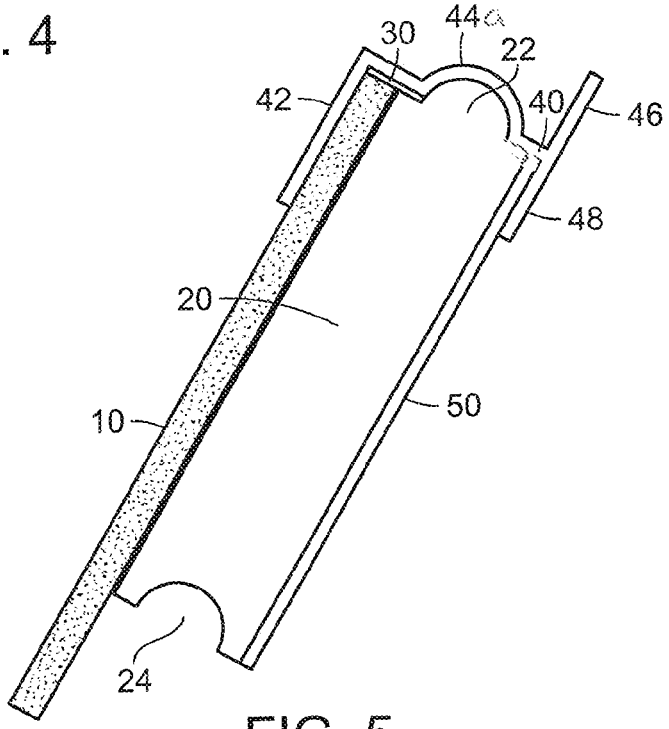
FIG. 5 shows a side view of another embodiment of the siding board/insulation board assembly. The figure shows the siding board 10, the insulation board 20 with a male extension 22 at its upper end and a female deep 24 at the lower end (the male extension would snugly fit into a female deep at a lower end of adjacent insulation board), and the clip 40. The clip has a front prong 42; a horizontal plate 44 having a groove 44 to adjust the male extension of the foam board, a hind prong 48 and an upwardly extending portion 46. In this embodiment the siding board/insulation board assembly additionally has a reflecting backing 50 attached on back side of the foam board. The attachment is illustrated with element number 30.

FIG. 5 shows a side view of another embodiment of the siding board/insulation board assembly. The figure shows the siding board 10, the insulation board 20 with a male extension 22 at its upper end and a female deep 24 at the lower end (the male extension would snugly fit into a female deep at a lower end of adjacent insulation board), and the clip 40. The clip has a front prong 42, a horizontal plate 44 having a groove 44*a* to adjust the male extension of the foam board, a hind prong 48 and an upwardly extending portion 46. In this embodiment the siding board/insulation board assembly additionally has a reflecting backing 50 attached on back side of the foam board. The attachment is illustrated with element number 30.

According to one embodiment the assembly includes a radiant backing 50 behind the insulation board shown in FIGS. 4 and 5. The backing may be glued or otherwise attached to the insulation board. According to one embodiment the insulation board has substantially vertical grooves on its back side and the radiant backing is attached so that its surface follows the grooves and ridges of the insulation board back.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed:

1. A building insulation and siding kit comprising;

at least two siding board/insulation board assemblies; and at least two attachment clips;

said siding board/insulation board assemblies comprising a flat rectangular siding board having a flat upper edge and a flat lower edge and a flat rectangular insulation board having a flat upper edge and a flat lower edge;

said insulation boards having a length substantially same as the length of the siding boards, and a width narrower than the width of the siding boards;

each of said siding boards being attached solely from their upper edges to the upper edges of the insulation boards;

said attachment clips having a substantially rectangular front prong perpendicularly attached to a substantially horizontal plate and extending downward from the horizontal plate, and a substantially rectangular hind prong being perpendicularly attached to the horizontal plate at an opposite end of the horizontal plate and extending downward from the horizontal plate, whereby the front prong and the hind prong form a fork like structure, and said hind prong additionally having an upwardly extending portion extending above the horizontal plate, wherein the upwardly extending portion of the hind prong and the downwardly extending portion of the hind prong are of substantially same length, and wherein the hind prong and/or the upwardly extending portion have one or more attachment holes;

the horizontal prong having a width substantially same as breadth of the siding board/insulation board assembly, whereby the siding board/insulation board assembly snugly fits on the horizontal plate between the forklike structure formed by the front prong and the hind prong of the clip;

wherein one siding board/insulation board assembly is inserted between the front and hind prongs of one clip, and the clip is attached to a building wall structure with fasteners through the attachment holes; and wherein another siding board/insulation board assembly is inserted between the front and hind prongs of another clip and aligned along the upper edge of the first insulation board.

2. The kit of claim 1, wherein the upper edge of the siding board is attached to the upper edge of the insulation board with a tape.

3. The kit of claim 2, wherein the tape includes stud markings indicating location of studs of the building, and thereby indicating preferable location of the clips for attaching on building studs.

4. A building insulation and siding kit comprising: at least two siding board/insulation board assemblies; and at least two attachment clips;

said siding board/insulation board assemblies comprising a flat rectangular siding board having a flat upper edge and a flat lower edge and a flat rectangular insulation board having an upper edge and a lower edge wherein the upper edge of the insulation foam board includes a male locking extension and the lower edge includes a matching female deep;

said insulation boards having a length substantially same as the length of the siding boards, and a width narrower than the width of the siding boards;

each of said siding boards being attached solely from their upper edges to the upper edges of the insulation boards;

said attachment clips having a substantially rectangular front prong perpendicularly attached to a substantially horizontal plate and extending downward from the horizontal plate, and a substantially rectangular hind prong being perpendicularly attached to the horizontal plate at an opposite end of the horizontal plate and extending downward from the horizontal plate, whereby the front prong and the hind prong form a fork like structure, and said hind prong additionally having an upwardly extending portion extending above the horizontal plate, wherein the upwardly extending portion of the hind prong and the downwardly extending portion of the hind prong are of substantially same length, and wherein the hind prong and/or the upwardly extending portion have one or more attachment holes; and the horizontal plate having an upward bend and a width substantially same as breadth of the siding board/insulation board assembly, whereby the siding board/insulation board assembly snugly fits on the horizontal plate between the forklike structure formed by the front and hind prongs of the clip and the upward bend mates the male locking extension;

wherein one siding board/insulation board assembly is inserted between the front and hind prongs of one clip, and the clip is attached to a building wall structure with fasteners through the attachment holes; and wherein a second siding board/insulation board assembly is inserted between the front and hind prongs of another clip and aligned along the upper edge of the first insulation board and the female locking deep of the second assembly matches the horizontal plate mating the male locking extension of the first assembly.

5. The kit of claim 1, wherein the insulation board has substantially vertical grooves on its back side.

6. The kit of claim 4, wherein the insulation board has substantially vertical grooves on its back side.

7. The kit of claim 1, wherein a radiant backing is attached on back side of the insulation board.

8. The kit of claim 4, wherein a radiant backing is attached on back side of the insulation board.

9. The kit of claim 1, wherein the siding boards are fiber cement boards, composite boards, vinyl boards, or wood boards.

* * * * *